US009315979B2

(12) United States Patent
Park

(10) Patent No.: US 9,315,979 B2
(45) Date of Patent: Apr. 19, 2016

(54) WATER-SAVING TYPE TOILET STOOL INCLUDING INTERMEDIATE RESERVOIR

(71) Applicant: JONGHO ENTERPRISE CO., LTD, Seoul (KR)

(72) Inventor: Yong-Tai Park, Seoul (KR)

(73) Assignee: JONGHO ENTERPRISE CO., LTD., Seoul (KR)

( * ) Notice: Subject to any disclaimer, the term of this patent is extended or adjusted under 35 U.S.C. 154(b) by 188 days.

(21) Appl. No.: 14/141,431

(22) Filed: Dec. 27, 2013

(65) Prior Publication Data

US 2015/0135422 A1 May 21, 2015

(30) Foreign Application Priority Data

Nov. 19, 2013 (KR) ..... 10-2013-0140617

(51) Int. Cl.

| | |
|---|---|
| ***E03D 1/00*** | (2006.01) |
| ***E03D 9/10*** | (2006.01) |
| ***E03D 11/02*** | (2006.01) |
| ***E03D 11/10*** | (2006.01) |
| ***E03D 11/11*** | (2006.01) |
| ***E03D 5/012*** | (2006.01) |
| ***E03D 9/052*** | (2006.01) |

(52) U.S. Cl.

CPC ..... *E03D 11/11* (2013.01); *E03D 5/012* (2013.01); *E03D 9/052* (2013.01); *E03D 9/10* (2013.01); *E03D 11/10* (2013.01)

(58) Field of Classification Search

CPC ..... E03D 5/012; E03D 9/052; E03D 9/10; E03D 11/10

USPC ..... 4/323, 415, 319, 422, 424, 434, 438, 4/442, 300

See application file for complete search history.

(56) References Cited

U.S. PATENT DOCUMENTS

| | | | | |
|---|---|---|---|---|
| 5,123,124 A * | 6/1992 | Brower | ..... | A47K 13/10 4/217 |
| 8,640,269 B2 * | 2/2014 | Davenport | ..... | E02B 13/02 222/165 |
| 2011/0113542 A1 * | 5/2011 | Stauber | ..... | E03D 3/12 4/434 |

FOREIGN PATENT DOCUMENTS

| | | |
|---|---|---|
| KR | 10-2005-0000186 | 1/2005 |
| KR | 10-2005-0081653 | 8/2005 |
| KR | 10-2005-0107240 | 11/2005 |

* cited by examiner

*Primary Examiner* — Huyen Le
*Assistant Examiner* — Christine Skubinna
(74) *Attorney, Agent, or Firm* — Jiang Chyun Intellectual Property Office

(57) ABSTRACT

Provided is a water-saving type toilet stool including an intermediate reservoir whereby water used in a toilet stool may be saved. In detail, provided is a water-saving type toilet stool including an intermediate reservoir, whereby excrement may be effectively discharged while using a small amount of water. Accordingly, water usage may be remarkably reduced by using the water-saving type toilet stool including an intermediate reservoir, compared to the conventional toilet stools.

7 Claims, 5 Drawing Sheets

WATER-SAVING TYPE TOILET STOOL INCLUDING INTERMEDIATE RESERVOIR

RELATED APPLICATIONS

This application claims the benefit of Korean Patent Application No. 10-2013-0140617, filed on Nov. 19, 2013, in the Korean Intellectual Property Office, the disclosure of which is incorporated herein in its entirety by reference.

BACKGROUND

1. Field

One or more embodiments of the present invention relate to a water-saving type toilet stool including an intermediate reservoir, and more particularly, to a water-saving type toilet stool including an intermediate reservoir whereby water used in the toilet stool may be saved.

2. Description of the Related Art

In daily life, the largest amount of water is used, for example, for toilet stools for treating excrement. In particular, while differing slightly according to the type of toilet stools, it is known that 10 to 15 liters of water is used in a toilet stool which is widely used at home or in industry per each use, and a person may use the toilet once or twice regarding feces, and five to ten times regarding urine.

As described above, use of an excessive amount of water causes unnecessary waste of water. As the toilet stool treats feces and urine separately, a large amount of water is used. Consequently, a toilet stool that uses less water than in the conventional art but is capable of effectively discharging excrement and maintaining cleanliness is required.

SUMMARY

One or more embodiments of the present invention include a water-saving type toilet stool including an intermediate reservoir, whereby excrement may be effectively discharged while using a small amount of water.

Additional aspects will be set forth in part in the description which follows and, in part, will be apparent from the description, or may be learned by practice of the presented embodiments.

According to one or more embodiments of the present invention, a water-saving type toilet stool including an intermediate reservoir, includes: a toilet stool main body that includes a receiving portion on which a user may sit to relieve oneself and in which excrement of the user is temporarily stored, a water supply flow path through which water is supplied to the receiving portion, and a discharge outlet that is formed at a lower portion of the receiving portion so as to discharge the excrement stored in the receiving portion; a manipulation button that is formed to be pressed by the user to discharge the excrement stored in the receiving portion to the discharge outlet; a control unit that receives a signal of the manipulation button; a water supply unit that is operated via the manipulation button to supply water to the water supply flow path of the toilet stool main body so as to discharge the excrement contained in the receiving portion through the discharge outlet; a discharging unit that includes a discharge valve that is installed at the discharge outlet of the toilet stool main body and is operated by using the control unit to open or close the discharge outlet of the toilet stool main body and a discharge pipe that is connected to the discharge outlet to transfer excrement and water discharged through the discharge outlet when the discharge outlet is opened via the discharge valve; and an intermediate reservoir unit that includes an intermediate reservoir that is connected to the discharge pipe of the discharging unit, is disposed below the toilet stool main body, includes an inlet through which the excrement discharged through the discharge pipe flows, and stores the excrement, a rotational axis that rotatably supports the intermediate reservoir such that the intermediate reservoir rotates due to a self-weight of the intermediate reservoir to discharge the excrement at a time when the intermediate reservoir is fully filled with the excrement after using the toilet stool main body a plurality of times, and a connection pipe that connects the intermediate reservoir and a piping so as to transfer the excrement to the piping that is connected to a septic tank of the building as the intermediate reservoir rotates to discharge the excrement stored in the intermediate reservoir.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Hereinafter, the present invention will be described in detail with reference to the attached drawings.

Figure 1:
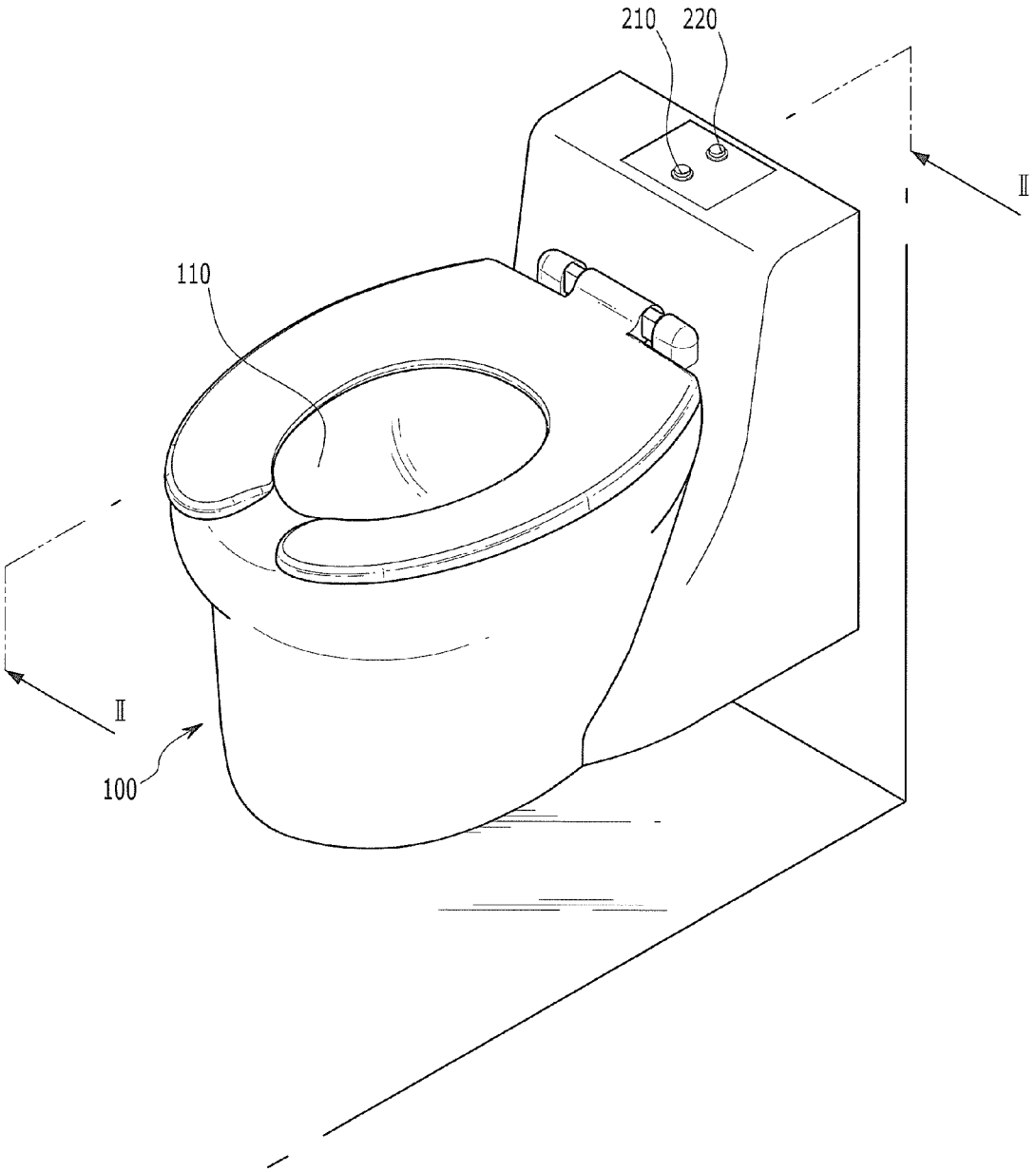
FIG. 1 is a perspective view illustrating a water-saving type toilet stool including an intermediate reservoir according to an embodiment of the present invention.

FIG. 1 is a perspective view illustrating a water-saving type toilet stool including an intermediate reservoir according to an embodiment of the present invention. FIGS. 2 through 5 are cross-sectional views of the water-saving type toilet stool of FIG. 1 cut along a line II-II, to explain an operating state of the water-saving type toilet stool, according to embodiments of the present invention.

Figure 2:
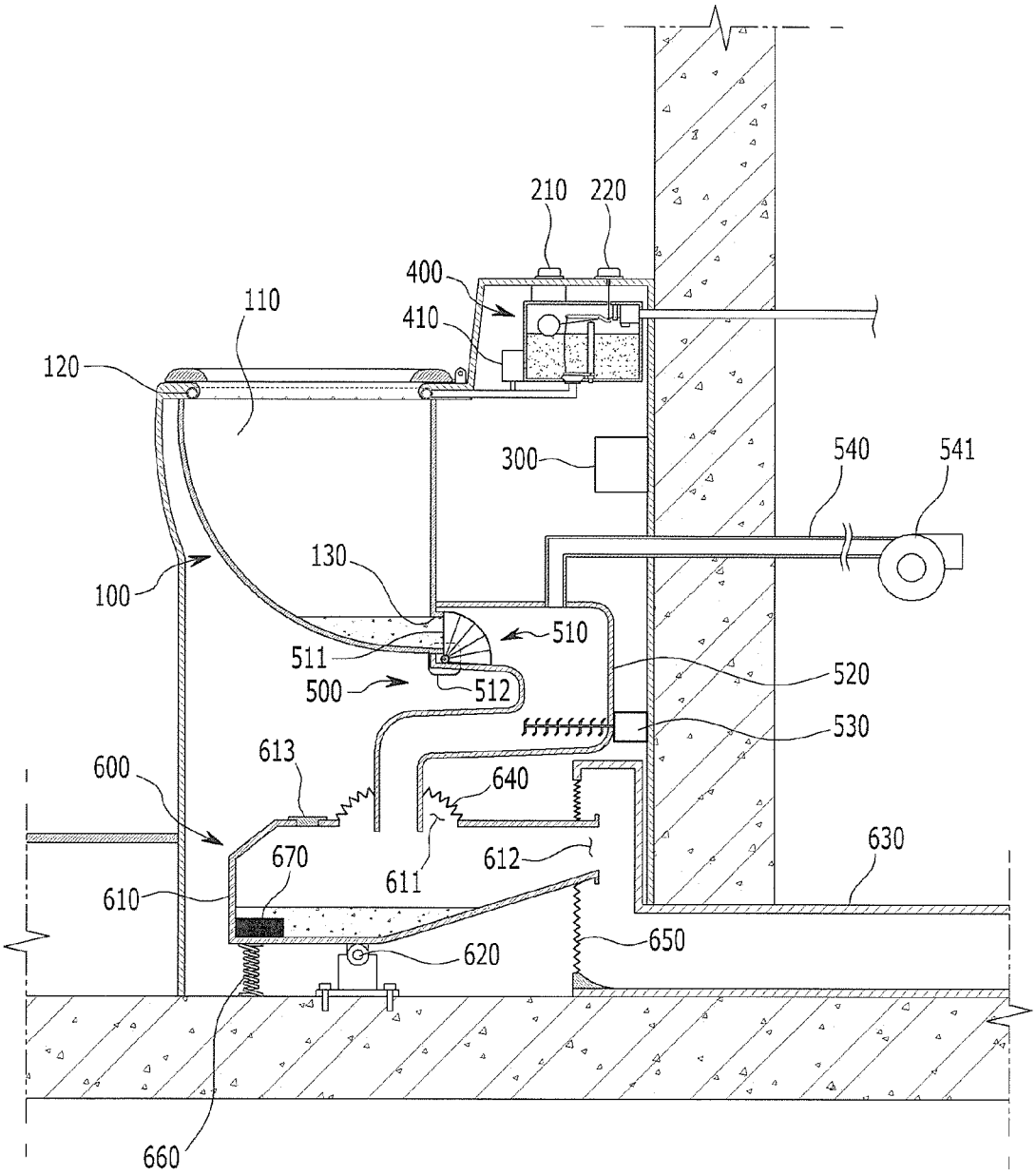
FIGS. 2 through 5 are cross-sectional views of the water-saving type toilet stool including an intermediate reservoir of FIG. 1 cut along a line II-II, to explain an operating state of the water-saving type toilet stool, according to embodiments of the present invention.

Referring to FIGS. 1 and 2, the water-saving type toilet stool includes a toilet stool main body 100, first and second manipulation buttons 210 and 220, a control unit 300, a water supply unit 400, a discharging unit 500, an intermediate reservoir unit 600.

The toilet stool main body 100 is configured such that a user may sit thereon to relieve oneself. The toilet stool main body 100 includes a receiving portion 110, a water supply flow path 120, and a discharge outlet 130. An upper portion of the receiving portion 110 has a structure on which a user may sit and is upwardly opened. A lower portion of the receiving portion 110 is concavely formed such that water may be collected therein and excrement of the user may fall downwards to be collected. The discharge outlet 130 is formed at the lower portion of the receiving portion 110 so that excrement stored in the receiving portion 110 may be discharged through the discharge outlet 130 to the outside. The water supply flow path 120 is formed at the upper portion of the toilet stool main body 100. The water supply flow path 120 is formed such that water supplied from the outside flows therethrough into the toilet stool main body 100 to be supplied to the receiving portion 110.

The water supply unit 400 supplies water through the water supply flow path 120 of the toilet stool main body 100 so as to discharge the excrement contained in the receiving portion 110 through the discharge outlet 130. The water supply unit 400 may have a structure whereby water is supplied to the water supply flow path 120 by opening or closing an electronic valve or a structure whereby water stored in a water tank is supplied to the water supply flow path 120 by using a mechanical buoy according to the conventional art. According to the current embodiment of the present invention, water supply conducted by using both an electronic water supply device and a mechanical water supply device as illustrated in FIG. 2 will be described.

In order to respectively operate the electronic water supply device and the mechanical water supply device as described above, the water-saving type toilet stool including an intermediate reservoir according to the current embodiment of the present invention includes two manipulation buttons, that is, a first manipulation button 210 and a second manipulation button 220. When a user presses the first manipulation button 210, an electrical signal is transmitted to the control unit 300 via the first manipulation button 210, and the control unit 300 opens a valve 410 of the electronic water supply device so as to supply water to the water supply flow path 120. When the user presses the second manipulation button 220, a valve at a lower portion of the water tank is opened via a lever of the mechanical water supply device, thereby supplying water of the water tank to the water supply flow path 120.

The control unit 300 receives a signal of the first manipulation button 210 to thereby operate a discharge valve 510 and a crusher 530 which will be described later.

The discharging unit 500 includes the discharge valve 510, a discharge pipe 520, the crusher 530, and an exhaust unit 540.

The discharge valve 510 is installed at the discharge outlet 130 of the toilet stool main body 100 and opens or closes the discharge outlet 130 according to an operational signal of the control unit 300. In regard to the water-saving type toilet stool including an intermediate reservoir according to the current embodiment of the present invention, the discharge valve 510 includes an opening/closing member 511 and an opening/closing motor 512. The opening/closing member 511 is rotatably installed in the discharge pipe 520, and the opening/closing motor 512 rotates the opening/closing member 511 according to a signal of the control unit 300 to thereby open or close the discharge outlet 130.

The discharge pipe 520 is formed to connect the discharge outlet 130 of the toilet stool main body 100 and an inlet 611 of an intermediate reservoir 610 which will be described later. Excrement and water that are discharged through the discharge outlet 130 as the discharge valve 510 opens the discharge outlet 130, are transferred to the intermediate reservoir 610 through the discharge pipe 520.

The exhaust unit 540 is connected to an upper portion of the exhaust pipe 520 and discharges stench inside the discharge pipe 520 to the outside. The discharging unit 540 includes an exhaust pipe and an exhaust pump 541. The exhaust pipe is connected to the upper portion of the discharge pipe 520 so as to absorb the air in the exhaust pipe 520. The exhaust pump 541 is connected to the exhaust pipe and operates to discharge the air in the exhaust pipe to the outside.

The crusher 530 is installed at the discharge pipe 520 and crushes excrement that flows into the discharge pipe 520. By finely crushing the excrement by using the crusher 530, the excrement that has been discharged from the receiving portion 110 may be easily transferred to the intermediate reservoir 610 through the discharge pipe 520.

The intermediate reservoir unit 600 includes the intermediate reservoir 610, a rotational axis 620, and a connection pipe 630. The intermediate reservoir 610 is disposed below the toilet stool main body 100. The intermediate reservoir 610 is in the form of a container having a size sufficient to temporarily store excrement and water that are discharged from the toilet stool main body 100 five to 30 times. The intermediate reservoir 610 includes the inlet 611 and an outlet 612. The inlet 611 is connected to the discharge pipe 520 so that excrement and water are received from the discharge pipe 520 through the inlet 611. The excrement and water stored in the intermediate reservoir 610 are transferred to the piping of the building through the outlet 612. The intermediate reservoir 610 is rotatably supported via the rotational axis 620. When excrement and water are stored in the intermediate reservoir 610 at a predetermined height, the intermediate reservoir 610 rotates with respect to the rotational axis 620 by the weight of the excrement and water to thereby discharge the excrement and water through the outlet 612. The connection pipe 630 connects the outlet 612 of the intermediate reservoir 610 and the piping of the building. The excrement and water discharged from the intermediate reservoir 610 is transferred to the piping connected to a septic tank of the building through the connection pipe 630.

The intermediate reservoir 610 may be configured to return to its original position by its self-weight after the intermediate reservoir 610 has rotated with respect to the rotational axis 620 and transferred the excrement and water stored in the intermediate reservoir 610 to the connection pipe 630, or the intermediate reservoir 610 may be configured to return to its original position by an elastic force of a returning member 660 as illustrated in FIG. 2. The returning member 660 may be formed of an elastic material and is installed between a ground surface and the intermediate reservoir 610. The returning member 660 provides an elastic force so as to rotate the intermediate reservoir 610 in a direction opposite to a rotational direction in which the intermediate reservoir 610 has rotated to discharge the excrement.

The intermediate reservoir unit 600 according to the current embodiment of the present invention may further include a weight 670 in order to rotate the intermediate reservoir 610 to return to its original position. The weight 670 is installed in the intermediate reservoir 610. Due to the weight of the weight 670, the intermediate reservoir 610 may maintain level without rotating until the intermediate reservoir 610 is fully filled with excrement. After rotating in order to discharge excrement, the intermediate reservoir 610 may rotate in an opposite direction to the rotational direction due to the weight of the weight 670 in addition to the elastic force of the returning member 660.

Meanwhile, a lower portion of the intermediate reservoir 610 may be preferably inclined. When the lower portion of the intermediate reservoir 610 is inclined as illustrated in FIG. 2, the excrement may be easily discharged according to an inclination of a lower surface of the intermediate reservoir 610 as the intermediate reservoir 610 rotates to discharge excrement to the outlet 612.

Figure 4:
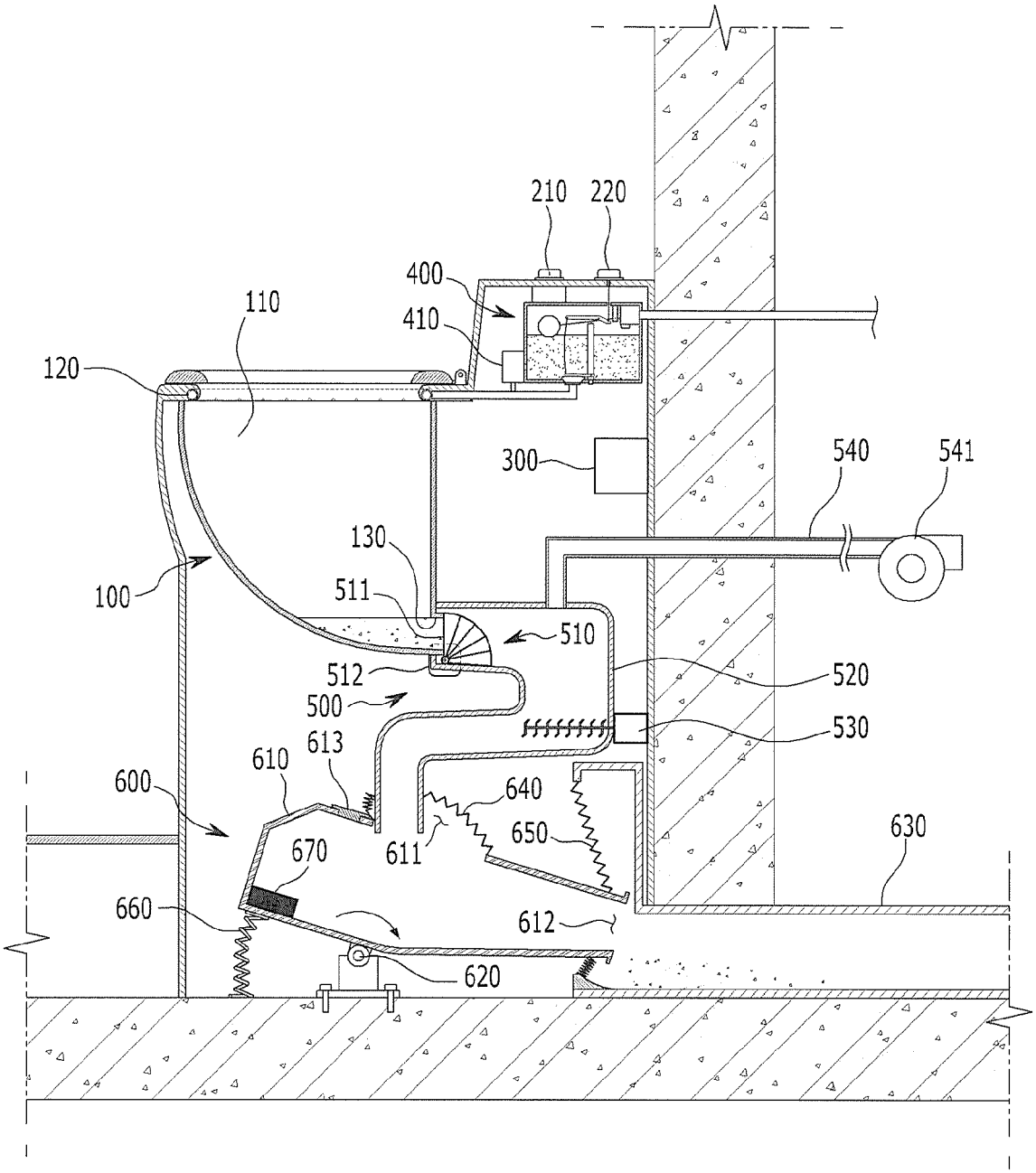

The intermediate reservoir unit 600 further includes a first sealing member 640 and a second sealing member 650. The first sealing member 640 and the second sealing member 650 prevent discharging of stench that is generated from the excrement stored in the intermediate reservoir 610, to the outside. The first sealing member 640 is installed between the discharge pipe 520 of the discharging unit 500 and the inlet 611 of the intermediate reservoir 610 to thereby closely seal space between the discharge pipe 520 and the inlet 611. The first sealing member 640 is formed in the form of a corrugated pipe so as to connect the discharge pipe 520 to the inlet 611 even when the intermediate reservoir 610 rotates, as illustrated in FIG. 4. The second sealing member 650 is installed between the outlet 612 of the intermediate reservoir 610 and the connection pipe 630 so as to closely seal space between the outlet 612 and the connection pipe 630. The second sealing member 650 is formed in the form of a corrugated pipe so as to connect the outlet 612 and the connection pipe 630 even when the intermediate reservoir 610 rotates, as illustrated in FIG. 4.

Meanwhile, a stopper 613 is installed at an upper portion of the intermediate reservoir 610. If a foreign substance flows into the intermediate reservoir 610 due to user's carelessness, the stopper 613 may be opened to remove the foreign substance in the intermediate reservoir 610.

Hereinafter, an operation of the water-saving type toilet stool including an intermediate reservoir, according to the current embodiment of the present invention configured as described above will be described.

In a preparation state before using the water-saving type toilet stool including an intermediate reservoir, according to the current embodiment of the present invention, the discharge outlet 130 is closed and a predetermined amount of water is filled in the receiving portion 110, as illustrated in FIG. 2. Either the intermediate reservoir 610 may be empty, or water and excrement discharged from the receiving portion 110 may be temporarily stored in the intermediate reservoir 610 as illustrated in FIG. 2.

Figure 3:
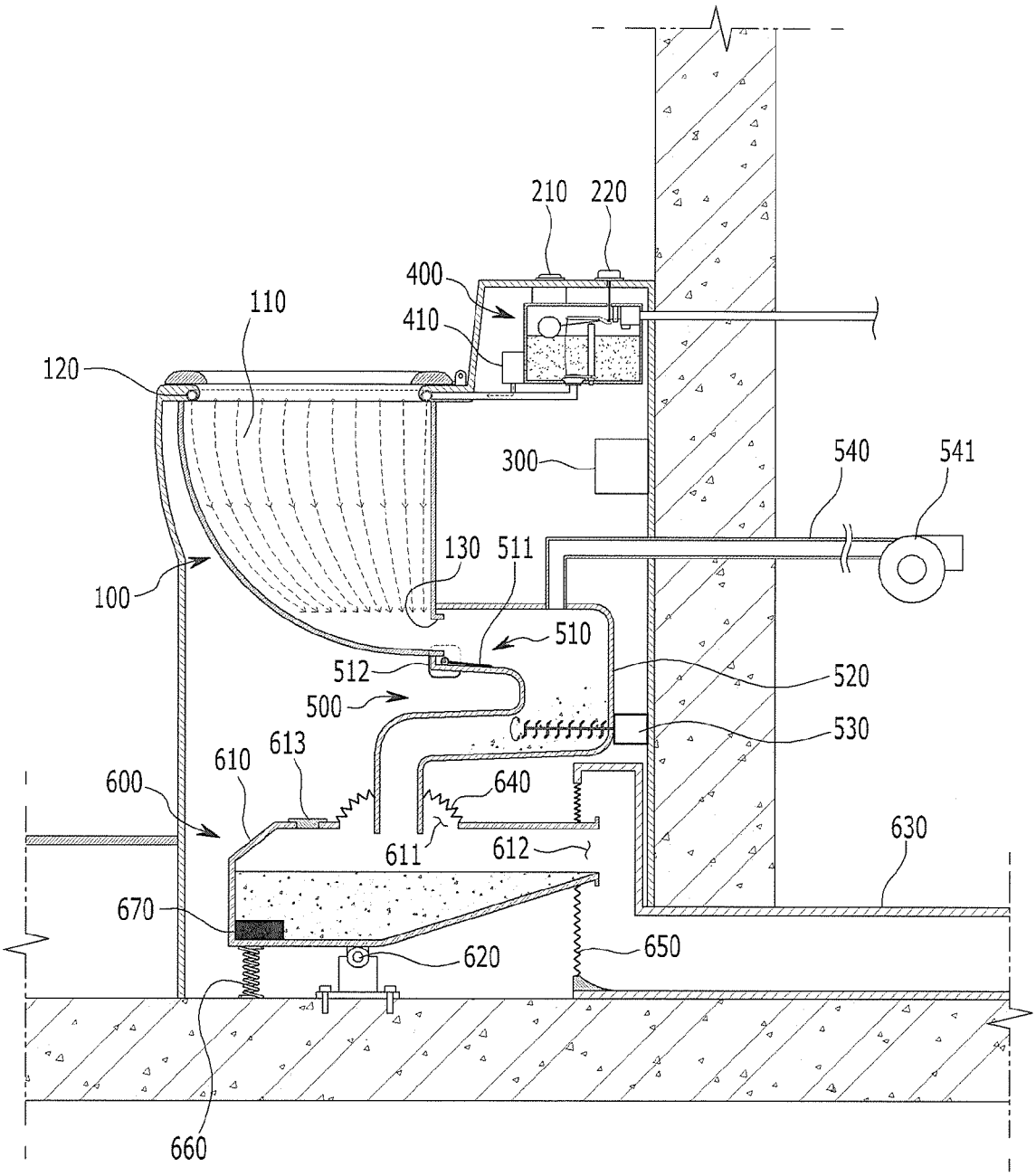

In this state, when a user sits on the toilet stool main body 100 to relieve oneself and then presses the first manipulation button 210, excrement and water stored in the receiving portion 110 are discharged to the intermediate reservoir 610. When the first manipulation button 210 is pressed, the control unit 300 receives a signal of the first manipulation button 210 to open the valve 410 of the electronic water supply device. At the same time, the control unit 300 operates the discharge valve 510 to open the discharge outlet 130 and operates the crusher 530, as illustrated in FIG. 3. The opening/closing motor 512 rotates the opening/closing member 511 to open the discharge outlet 130. As illustrated in FIG. 3, water that has passed through the valve 410 of the electronic water supply device and has flown into the receiving portion 110 through the water supply flow path 120 discharges the excrement in the receiving portion 110 to the discharge pipe 520. The water-saving type toilet stool including an intermediate reservoir, according to the current embodiment of the present invention does not use a trap structure as in a conventional, mechanical toilet stool but the discharge pipe 520 is straightly connected to the discharge outlet 130 of the receiving portion 110, and thus, the excrement of the receiving portion 110 may be discharged using just a small amount of water. As described above, due to a structure of the receiving portion 110 and the discharge pipe 520, water may be saved according to the water-saving type toilet stool including an intermediate reservoir, of the current embodiment of the present invention.

The excrement that moves through the discharge pipe 520 is crushed into small particles by the crusher 530 and flows into the intermediate reservoir 610 and is temporarily stored therein. As described above, the intermediate reservoir 610 has a size that is sufficient to temporarily store water and excrement that are discharged five to 30 times from the toilet stool main body 100. Instead of discharging the excrement to the piping connected to a septic tank of the building every time, just an amount of water that is sufficient to transfer the excrement stored in the receiving portion 110 to the intermediate reservoir 610 disposed below the toilet stool main body 100 is to be supplied to the water supply unit 400, and thus, a remarkably small amount of water may be used in the water-saving type toilet stool including an intermediate reservoir of the current embodiment of the present invention, compared to the conventional toilet stools.

When a preset period of time has elapsed so that water and excrement stored in the receiving portion 110 are discharged through the discharge outlet 130, the control unit 300 operates the discharge valve 510 to close the discharge outlet 130. When the discharge outlet 130 is closed and a time period required for water to be filled in the lower portion of the receiving portion 110 has elapsed, the control unit 300 operates the water supply unit 400 to stop water supply.

When water and excrement are collected in the intermediate reservoir 610 to fully fill the intermediate reservoir 610 after the toilet stool main body 100 has been used several times, the intermediate reservoir 610 rotates to discharge the excrement to the piping of the building, as illustrated in FIG. 4.

As the rotational axis 620 is separated from the center of gravity of the intermediate reservoir 610 by a predetermined distance, when the intermediate reservoir 610 is fully filled, the intermediate reservoir 610 rotates with respect to the rotational axis 620. Here, due to the operations of the returning member 660 and the weight 670 installed in the intermediate reservoir 610, the intermediate reservoir 610 maintains level until it is fully filled.

As illustrated in FIG. 4, when the intermediate reservoir 610 rotates, the excrement and water in the intermediate reservoir 610 are discharged through the outlet 612 and pass through the connection pipe 630 to be gushed out to the piping of the building. As the lower portion of the intermediate reservoir 610 is inclined as described above, the water and excrement in the intermediate reservoir 610 may be more easily discharged to the connection pipe 630. Although the excrement is discharged from the toilet stool main body 100 using a small amount of water, since water and excrement are discharged from the intermediate reservoir 610 at a time after the intermediate reservoir 610 is fully filled with water and excrement, the intermediate reservoir 610 may be effectively emptied due to the self-weight of the water and excrement. Also, instead of using a large amount of water in the intermediate reservoir 610 each time, excrement and water are collected in the intermediate reservoir 610 after using the toilet stool main body 100 five to 30 times and then are discharged at a time. Accordingly, water usage may be remarkably reduced.

Meanwhile, even when the intermediate reservoir 610 rotates, a connection state between the discharge pipe 520 and the inlet 611 may be maintained and space therebetween may be closely sealed from the outside by using the first sealing member 640, and a connection state between the connection pipe 630 and the outlet 612 may be maintained and space therebetween may be closely sealed from the outside by using the second sealing member 650. Consequently, stench that is generated in the intermediate reservoir 610 may not leak. The stench generated in the intermediate reservoir 610 may be discharged to an exhaust pipe of the building after passing through the discharge pipe 520 via the discharging unit 540.

When the intermediate reservoir 610 is completely emptied, the intermediate reservoir 610 rotates in an opposite direction to a rotational direction thereof again via the operations of the weight 670 and the returning member 660 to be in the state as illustrated in FIG. 2 again.

Meanwhile, water supply to the receiving portion 110 by using the electronic water supply device has been described above with reference to FIG. 3, according to circumstances, water may be supplied to the receiving portion 110 also by using a mechanical water supply device as illustrated in FIG.

Figure 5:
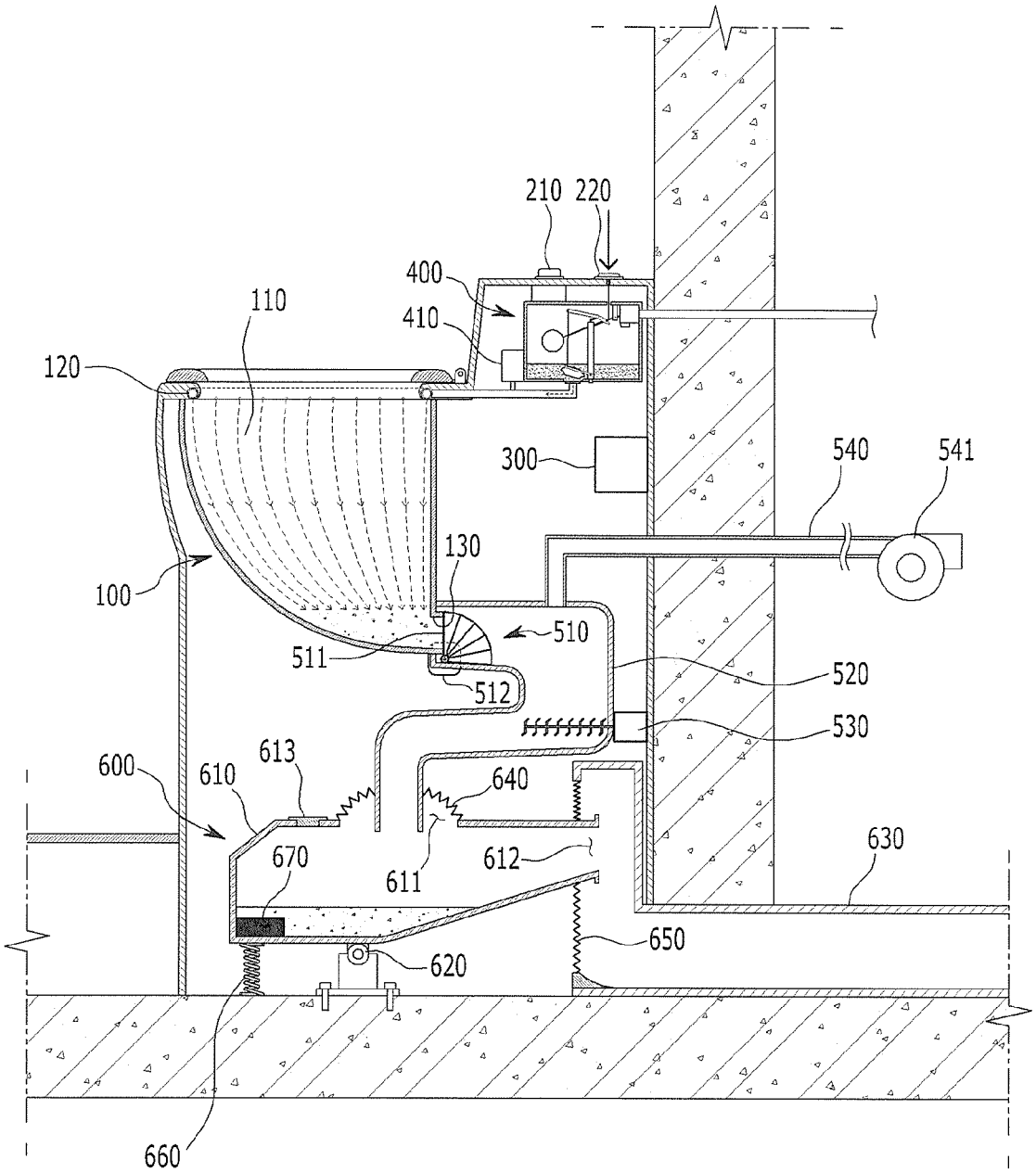

5. That is, when the user presses the second manipulation button 220, a valve formed at a lower surface of a water tank of the mechanical water supply device is opened to supply water into the water supply flow path 120, as illustrated in FIG. 5. Also when the second manipulation button 220 is pressed, the control unit 300 senses the second manipulation button 220 being pressed, thereby operating the discharge valve 510 and the crusher 530.

While the water-saving type toilet stool including an intermediate reservoir according to exemplary embodiments has been described, the scope of the invention is not limited to the structure described and illustrated above.

For example, the intermediate reservoir unit may not include the weight 670 or the returning member 660.

In addition, the discharge valve 510 may have other various structures where a discharge pipe or a discharge outlet may be opened or closed using other structures than those described and illustrated above.

Also, the structures of the first sealing member 640 and the second sealing member 650 are not limited to those described and illustrated above, and according to circumstances, the water-saving type toilet stool including an intermediate reservoir may not include the first sealing member 640 and the second sealing member 650.

In addition, the rotational axis of the intermediate reservoir unit described above may be slidably installed with respect to the ground surface on which the rotational axis is installed. By slidably installing the rotational axis with respect to the ground surface, rotational motion of the intermediate tank may be further facilitated.

As described above, according to the water-saving type toilet stool including an intermediate reservoir of the one or more of the above embodiments of the present invention, water usage may be significantly reduced compared to the conventional toilet stools.

What is claimed is:

1. A water-saving type toilet stool including an intermediate reservoir, comprising:

a toilet stool main body that includes a receiving portion on which a user may sit to relieve oneself and in which excrement of the user is temporarily stored, a water supply flow path through which water is supplied to the receiving portion, and a discharge outlet that is formed at a lower portion of the receiving portion so as to discharge the excrement stored in the receiving portion;

a manipulation button that is formed to be pressed by the user to discharge the excrement stored in the receiving portion to the discharge outlet;

a control unit that receives a signal of the manipulation button;

a water supply unit that is operated via the manipulation button to supply water to the water supply flow path of the toilet stool main body so as to discharge the excrement contained in the receiving portion through the discharge outlet;

a discharging unit that comprises a discharge valve that is installed at the discharge outlet of the toilet stool main body and is operated by using the control unit to open or close the discharge outlet of the toilet stool main body and a discharge pipe that is connected to the discharge outlet to transfer excrement and water discharged through the discharge outlet when the discharge outlet is opened via the discharge valve; and an intermediate reservoir unit that comprises an intermediate reservoir that is connected to the discharge pipe of the discharging unit, is disposed below the toilet stool main body, includes an inlet through which the excrement discharged through the discharge pipe flows, and stores the excrement, a rotational axis that rotatably supports the intermediate reservoir such that the intermediate reservoir rotates due to a self-weight of the intermediate reservoir to discharge the excrement at a time when the intermediate reservoir is fully filled with the excrement after using the toilet stool main body a plurality of times, and a connection pipe that connects the intermediate reservoir and a piping so as to transfer the excrement to the piping that is connected to a septic tank of the building as the intermediate reservoir rotates to discharge the excrement stored in the intermediate reservoir, wherein the discharge valve of the discharging unit comprises a closing/opening member that is rotatably installed in the discharge pipe and a closing/opening motor that opens or closes the discharge outlet by rotating the opening/closing member, wherein the intermediate reservoir unit further comprises a first sealing member that is formed in the form of a corrugated pipe and closely seals space between the discharge pipe of the discharging unit and the inlet of the intermediate reservoir from the outside and connects the discharge pipe of the discharging unit and the inlet of the intermediate reservoir even when the intermediate reservoir rotates.

2. The water-saving type toilet stool including an intermediate reservoir of claim 1, wherein the discharging unit further comprises a crusher that crushes excrement flowing into the discharge pipe.

3. The water-saving type toilet stool including an intermediate reservoir of claim 1, wherein the intermediate reservoir unit further comprises a returning member that is formed of an elastic material and is installed in the intermediate reservoir so as to provide an elastic force in a direction in which the intermediate reservoir rotates to an original position of the intermediate reservoir after the intermediate reservoir has rotated to discharge the excrement stored in the intermediate reservoir.

4. The water-saving type toilet stool including an intermediate reservoir of claim 1, wherein the intermediate reservoir unit further comprises a weight that is installed in the intermediate reservoir such that the intermediate reservoir does not rotate but maintains level until the intermediate reservoir is fully filled with excrement.

5. The water-saving type toilet stool including an intermediate reservoir of claim 1, wherein a lower portion of the intermediate reservoir of the intermediate reservoir unit is inclined such that excrement that is discharged to the piping as the intermediate reservoir rotates, slides due to gravity to be discharged to the piping.

6. The water-saving type toilet stool including an intermediate reservoir of claim 1, wherein the intermediate reservoir unit further comprises a second sealing member that is formed in the form of a corrugated pipe and closely seals space between the intermediate reservoir and the connection pipe from the outside and connects the intermediate reservoir and the connection pipe even when the intermediate reservoir tank rotates.

7. The water-saving type toilet stool including an intermediate reservoir of claim 1, wherein a rotational axis of the intermediate reservoir unit is slidably installed with respect to a ground surface on which the rotational axis is installed.

* * * * *